US005211044A

United States Patent [19]

Kim

[11] Patent Number: 5,211,044

[45] Date of Patent: May 18, 1993

[54] UNIVERSAL LOCK AND KEY

[76] Inventor: Kwon W. Kim, 1500 3rd Ave., #64, Chula Vista, Calif. 91911

[21] Appl. No.: 820,235

[22] Filed: Jan. 14, 1992

[51] Int. Cl.[5] ..... E05B 25/00; E05B 19/18

[52] U.S. Cl. ..... 70/371; 70/384; 70/385; 70/395; 70/398; 70/411

[58] Field of Search ..... 70/371, 375, 378, 367, 70/368, 358, 338, 382–385, 387, 490, 493, 395, 398, 401, 406–409, 411

[56] References Cited

U.S. PATENT DOCUMENTS

| | | | |
|---|---|---|---|
| 591,901 | 10/1897 | Trotman | 70/395 |
| 2,430,914 | 11/1947 | Ciani | 70/411 |
| 2,440,429 | 4/1948 | Best | 70/395 |
| 3,149,486 | 9/1964 | Russell et al. | 70/384 |
| 3,243,979 | 4/1966 | Silvern | 70/398 |
| 3,431,757 | 3/1969 | Hori | 70/383 |
| 4,372,139 | 2/1983 | Laake | 70/383 |
| 4,545,226 | 10/1985 | Urrestarazu-Borda | 70/398 X |
| 4,712,401 | 12/1987 | Monahan | 70/385 X |
| 4,850,210 | 7/1989 | Adler et al. | 70/375 X |
| 4,912,953 | 4/1990 | Wobig | 70/337 X |

*Primary Examiner*—Peter M. Cuomo
*Assistant Examiner*—Suzanne L. Dino

[57] ABSTRACT

A universal lock and key assembly in which the lock is re-keyable and the key is also changeable. The key has a shank portion having a longitudinally extending tooth slot in its top surface. A plurality of teeth have their bottom ends inserted into the tooth slot in any desired sequence to give a predetermined profile to the teeth of the key. The bottom pin cylinder of the lock has mating bottom pins for each of the respective teeth. These are then arranged in a coordinated sequence in the bottom pin cylinder of the lock. The structure of the system allows an individual to change both the configuration of the key and also the mating structure within the lock so it will be operable.

10 Claims, 3 Drawing Sheets

UNIVERSAL LOCK AND KEY

BACKGROUND OF THE INVENTION

The invention relates to locks and more particularly a pin tumbler cylinder lock that can be re-keyed to be opened by a key whose teeth can be arranged in a mating longitudinal sequence to open the lock. In the past most pin tumbler cylinder locks were not capable of being re-keyed. As a consequence, if a person lost his key, it was often necessary to replace the entire lock or require the services of a locksmith.

The Hori U.S. Pat. No. 3,432,757 is directed to a multiple key lock having a change key mechanism. It is a conventional pin-type key operated lock having a blocking needle originally positioned in a cavity in the shell adjacent the rotatable core locking certain inoperable pins, with the shell parts thereof inoperable in the shell and free of blocking a remaining operable pin. An original master key properly positions the operable pin and the core pins parts in the inoperable pins for rotation of the core while a back key surface prevents the blocking needle from moving radially into the key slot during rotation. A change key is functionally identical to the master key, except for a recess on its back surface receiving the blocking needle therein for removal from the core with the change key. This frees all of the pins for subsequent rotation of the core only by a properly formed final key.

In more recent years, improved pin tumbler cylinder locks have been designed which allow a combination to be changed. The Burlingame U.S. Pat. No. 3,910,083 discloses a combination changing cylinder lock that allows the service key to be changed externally without access to the lock interior. His cylinder lock has tumbler pins comprising a plurality of interlocking segments, the interfaces of adjacent pairs of segments being such that the adjacent segments may be placed in shear, blocking, or passover orientations dependent upon their relative rotations. To change the combination of the service key, a master key is used to place each pair of adjacent pin segments in the shear orientation. A service key having the desired new combination is then used to operate the lock and the adjacent pin segment pairs are selectively placed in the locking or passover orientations depending upon the requirements of the new combination.

The Monahan U.S. Pat. No. 4,712,401 relates to a method of re-keying a pin tumbler cylinder lock having tumbler pins, driver pins and at least one master pin without disassembly of the lock apparatus or removal or replacement of any master pins therefrom.

The Shen U.S. Pat. No. 4,732,023 is directed to a modifiable cylinder. The primary object of the invention is to provide a modifiable cylinder in which the combination of pin tumblers in disks of the cylinder are changed by a designated key so that the original cylinder will become useless and a lock can be operated only by this designated key.

The Silvern U.S. Pat. No. 3,243,979 relates to an improved key that can be varied into configurations to fit different lock arrangements.

The Urrestarazu-Borda U.S. Pat. No. 4,545,226 is directed to a combination key that permits the opening of various locks with a single key.

It is an object of the invention to provide a novel lock and key assembly that has a key whose teeth are removable and rearrangeable in various sequences.

It is also an object of the invention to provide a novel universal lock and key assembly that has structure for temporarily locking its top pins in its top pin housing portion while its bottom pins are being removed.

It is another object of the invention to provide a novel universal lock and key assembly that has structure for removing its bottom pins from its tubular sleeve without disassembling these two members from each other.

It is an additional object of the invention to provide a novel lock and key assembly that is economical to manufacture and market.

It is a further object of the invention to provide a novel lock and key assembly that is can have the teeth of its key and the bottom pins of its bottom pin cylinder rearranged by an untrained do-it-yourselfer.

SUMMARY OF THE INVENTION

The universal lock and key system has been designed to have a key structure that is re-keyable and a lock structure that is re-keyable. The re-keying operation for the lock can be accomplished without removing the bottom pin cylinder from the tubular sleeve portion of the lock.

The key is formed from two primary components, an elongated shank portion and a key handle. The shank portion has an elongated tooth slot formed in its top surface that extends all the way to its rear end and the tooth slot has a predetermined cross sectional configuration to accommodate flanges on the key tooth members that are insertable.

These key tooth members have predetermined heights and they are assigned a numerical that is read in sequence from left to right to give the combination of the key and lock.

The basic components of the universal lock structure are the combination top pin housing and tubular sleeve assembly and the bottom pin cylinder. The top pin housing portion has a plurality of vertical top pin bore holes formed therein that extend from its bottom end to its top end. These top pin bore holes are aligned along a longitudinal axis and a top pin and spring are removeably received in all but one of the bore holes. A controller pin along with a spring is removeably received in the last bore hole.

The top pin housing portion has an elongated control sheet slot extending horizontally inwardly from one of its sides all the way into the respective top pin bore holes. A control sheet having a grooved bottom gear surface is movable inwardly and outwardly in the control sheet slot by a control screw gear that extends through a longitudinally extending horizontal bore hole in the top pin housing portion. A control screw on one end of the control screw gear can be turned with a screwdriver to cause the front edge of the control sheet to be moved into a locking position in the annular grooves of the top pins. When this occurs the top pins all have their bottom ends aligned in a horizontal plane and they are not allowed to extend downwardly into the tubular sleeve portion. Except for the time when the combination of the lock is being changed, the control sheet would be retracted away from contact with the annular grooves of the respective top pins.

The keyway cylinder has a plurality of vertical bore holes aligned along its longitudinal axis. These mate with the respective bottom ends of the vertical bore holes of the top pin housing portion. A key slot extends longitudinally into the bottom pin cylinder and its forward progress is restricted by a key stop. The top edges of the teeth of the key align with the bottom ends of the vertical bore holes in the bottom pin cylinder. Bottom pins having various heights are removably inserted in these bore holes in a pattern according to the teeth of the key. If the proper key is inserted into the bottom pin cylinder, all the bottom pins in the bottom pin cylinder will have their top ends flush with the top surface of the bottom pin cylinder thus allowing it to be rotated. A shoulder formed on the rear end of the bottom pin cylinder can then engage actuating structure for unlatching a locking mechanism.

When it is desired to change to combination of the lock, the control sheet is actuated transversely until it engages the respective annular grooves of the top pins. Next the bottom pin cylinder can be rotated until its vertically oriented bore holes are in alignment with the bottom pin apertures of the tubular sleeve portion. The bottom pins then drop outwardly and since they are of different heights and have a different number assigned to them, they can be arranged in a new combination after which the key has its teeth removed and reassembled with the numbers of the teeth in the same sequence as the numbers of the bottom pins.

Once the re-keying operation has been completed the newly configured key is inserted into the bottom pin cylinder, and then it is rotated until its vertical bore holes are aligned with the vertical bore holes of the top pin housing. Next the control sheet is actuated to unlock the top pins and the universal lock and key system is operational again.

DESCRIPTION OF THE PREFERRED EMBODIMENT

The novel universal lock and key system will now be described by referring to FIGS. 1–18 of the drawings.

Figure 1:
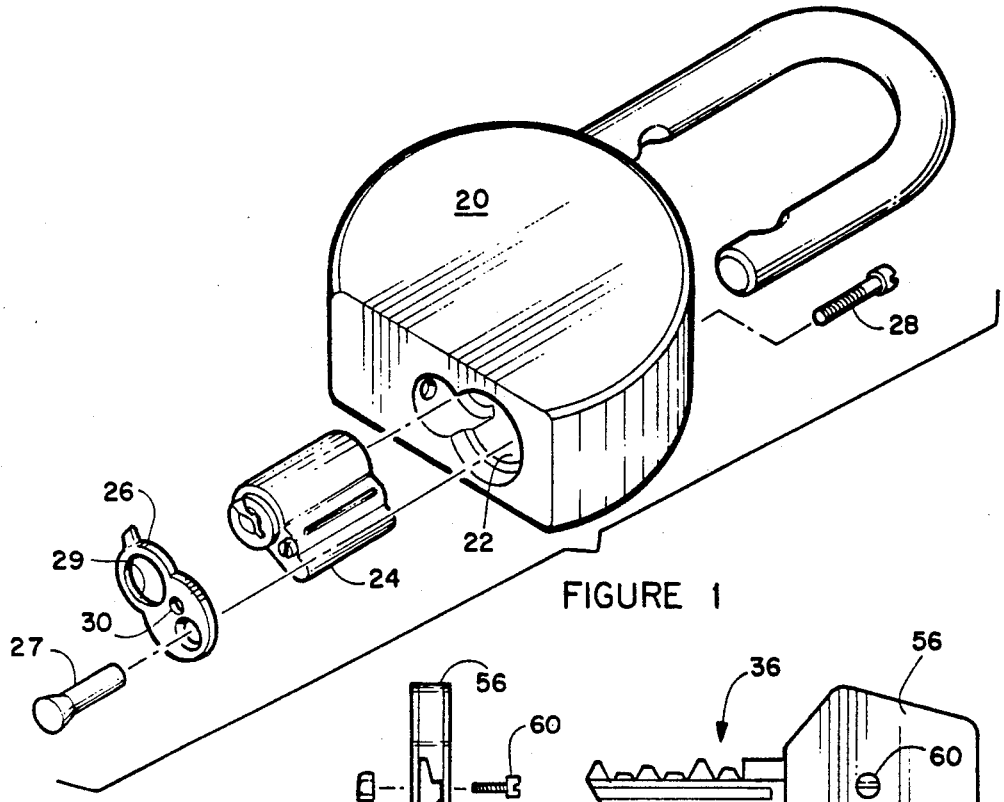
FIG. 1 is an exploded perspective view of the novel universal lock showing it mounted in a padlock housing.
Figure 3:
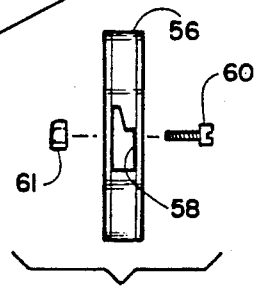
FIG. 3 is a front elevation view of the key handle as dissassembled from the key illustrated in FIG. 2.
Figure 2:
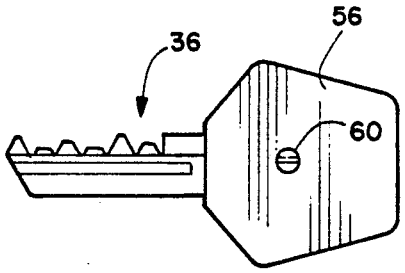
FIG. 2 is a side elevation view of the novel key assembly.
Figure 4:
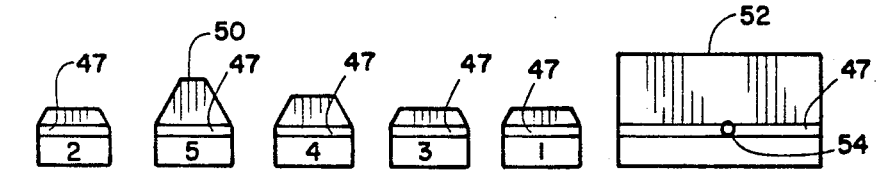
FIG. 4 is a side elevation view of the different individual key teeth.
Figure 5:
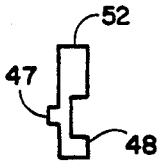
FIG. 5 is an end elevation view of the key panel illustrated in FIG. 4.

In FIG. 1, the universal lock and key system is shown in use with a padlock housing 20. It has a cavity 22 that removably receives the combination top housing and tubular sleeve assembly 24. Once inserted in its proper position in cavity 22, a cap 26 is positioned over the top of cavity 22 and secured therein by internally threaded cap pin 27 and bolt 28. Cap 26 has a hole 29 for giving access to the key slot of the bottom pin cylinder 94. A separate hole 30 provides access to the control screw 92.

Figure 7:
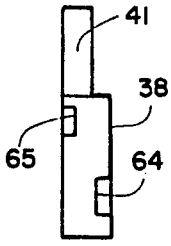
FIG. 7 is a front elevational view taken along lines 7—7 of FIG. 6.
Figure 6:
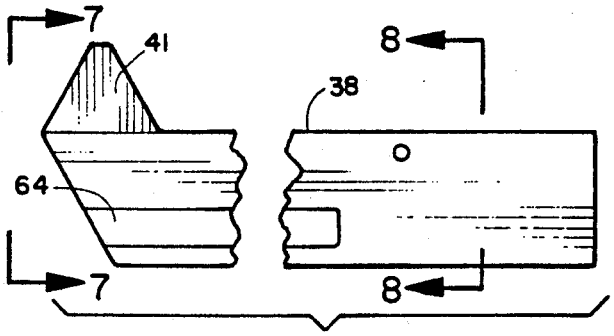
FIG. 6 is a side elevation view of the shank of the key.
Figure 8:
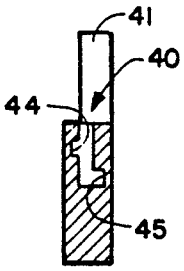
FIG. 8 is a cross sectional view taken along lines 8—8 of FIG. 6.
Figure 9:
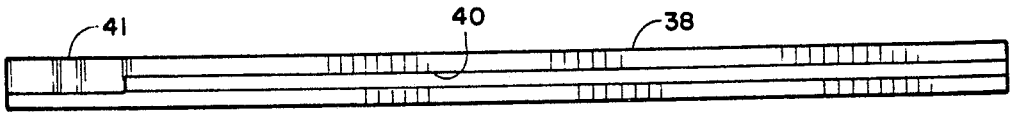
FIG. 9 is a top plan view of the shank of the key.
Figure 10:
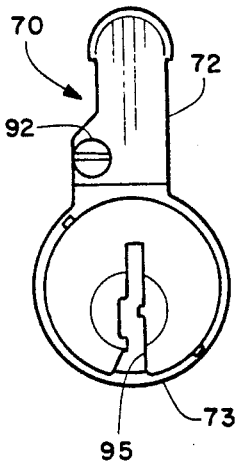
FIG. 10 is a front elevation view of the universal lock assembly.
Figure 11:
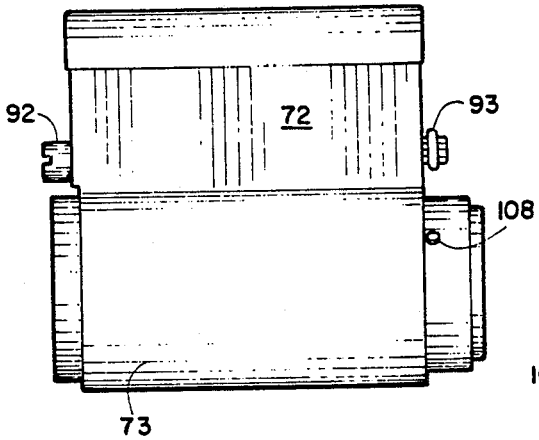
FIG. 11 is a side elevation view of the universal lock assembly.
Figure 12:
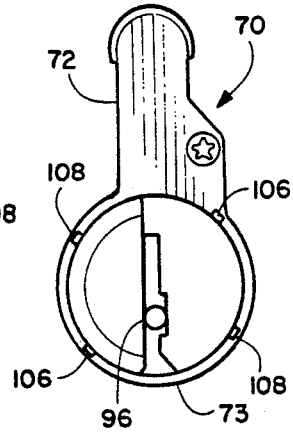
FIG. 12 is a rear elevation view of the universal lock assembly.
Figure 13:
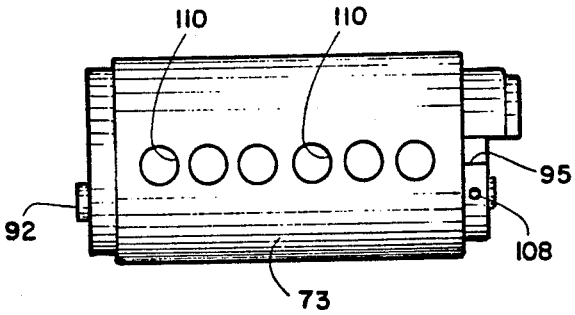
FIG. 13 is a bottom plan view of the universal lock assembly.
Figure 14:
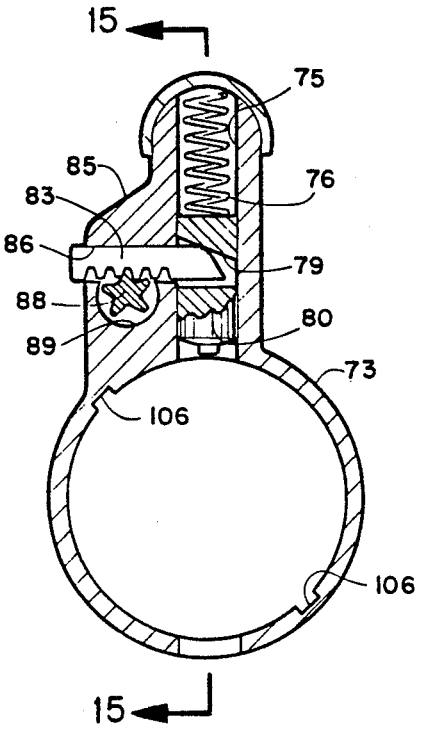
FIG. 14 is a cross sectional view of the combination top pin housing and tubular sleeve taken along lines 14—14 of FIG. 15.
Figure 15:
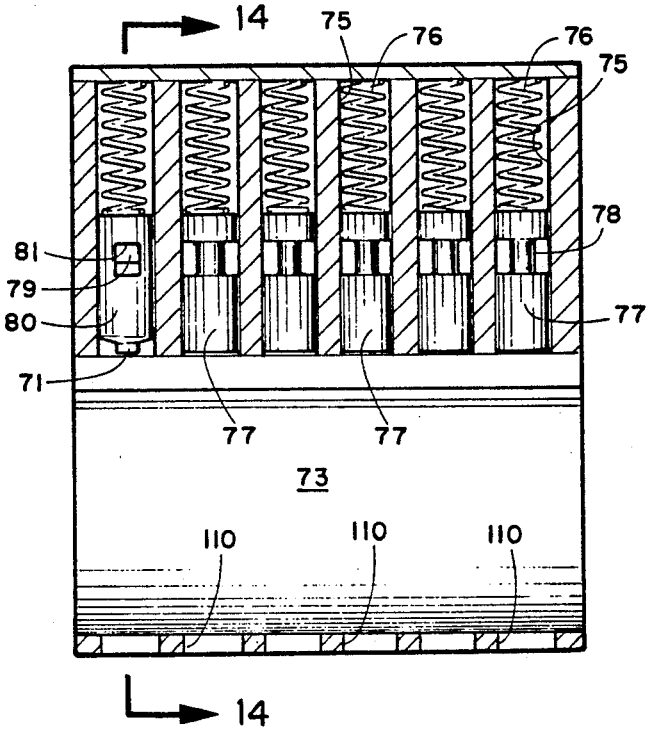
FIG. 15 is a cross sectional view of the combination top pin housing and tubular sleeve taken along lines 15—15 of FIG. 14.
Figure 16:
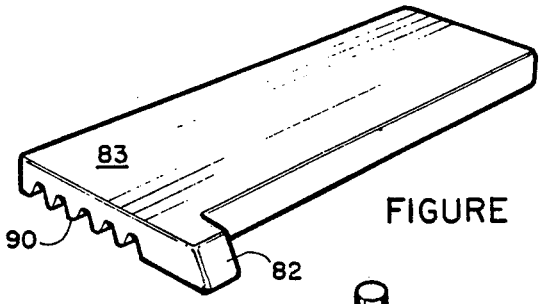
FIG. 16 is a rear perspective view of the control sheet.
Figure 17:
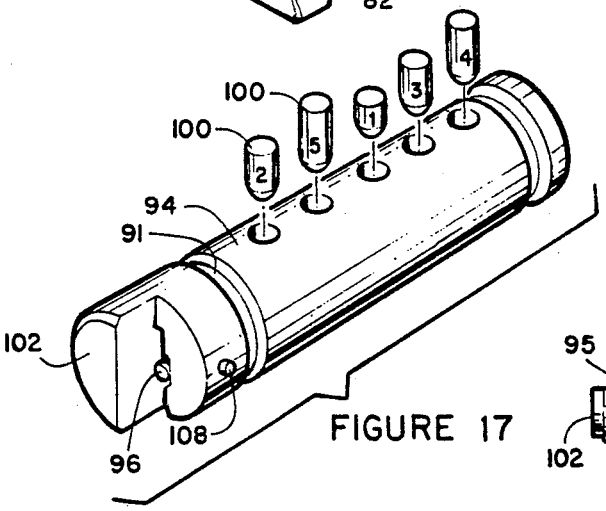
FIG. 17 is a rear perspective view of the bottom pin cylinder.
Figure 18:
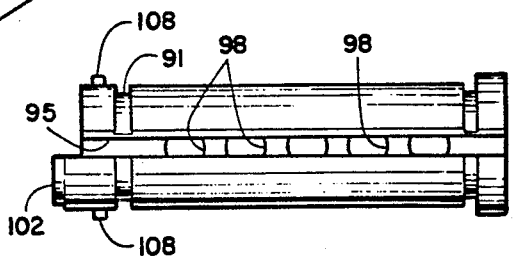
FIG. 18 is a bottom plan view of the bottom pin cylinder.

The structure of the key 36 is illustrated in FIGS. 2–9. It has an elongated shank portion 38 having a tooth slot 40 formed in its top surface that extends from its rear end all the way up to stationary front tooth 41. The cross section of the tooth slot 40 is best illustrated in FIG. 8 which shows that it has laterally extending grooves 44 and 45 that mate with flanges 47 and 48 (see FIG. 5) that are on each of the key teeth 50 and key panel 52. An aperture 54 aligns with an aperture in key handle 56. Key handle 56 has a cavity 58 that receives the rear end of key panel 52 and shank portion 38. A bolt 60 passes through aligned apertures in key handle 56 and then through aperture 54 of key panel 52 and is secured by nut 61. Key teeth 50 have various predetermined heights and have been assigned a number only for identification purposes only. When the teeth are in their predetermined assigned sequence in the key, the numbers on the teeth determine the combination number of the key and lock. FIG. 7 shows a front elevational view of shank portion 38 indicating that their are lateral side slots 64 and 65 in the forward end of shank portion 38.

Combination top pin housing and sleeve assembly 70 is best illustrated in FIGS. 10–18. It has a top pin housing portion 72 and a tubular sleeve portion 73. A plurality of vertical bore holes 75 extend from the top end of top pin housing 72 to its bottom end. Springs 76 and top pins 77 are received within these vertical bore holes. Each top pin has an annular groove 78. A controller pin 80 is received in the rear vertical bore hole and it has a horizontal aperture 81 with a beveled surface 79 that removably receives locking finger 82 of control sheet 83. Top pin housing portion 72 has a knob portion 85 formed along its one lateral side and a horizontal control sheet slot 86 passes therethrough all the way to the respective bore holes 75. Control sheet 83 is mounted within control sheet slot 86. A control screw gear 88 passes through a horizontal bore hole 89 and its teeth mesh with gear surface 90 of control sheet 83. A control screw 92 is mounted on one end of control screw gear 88 and C-clamp spring 93 locks its other end. As locking finger 82 travels into horizontal aperture 81 it engages beveled surface 79 causing controller pin 80 to be lifted upwardly to remove its protrusion 71 on its bottom end to be lifted out of annular groove 91 of bottom pin cylinder 94 thus releasing it so that it can be removed from tubular sleeve portion 73.

Bottom pin cylinder 94 has key slot 95 formed in its bottom surface. A key stop 96 limits the amount that the key can be inserted. A plurality of bottom pin apertures 98 extend from the top surface of bottom pin cylinder 94 to key slot 95. A plurality of bottom pins 100 have different heights and they are assigned numbers that coordinate with the numbers of the key teeth 50. A shoulder 102 is formed on the rear end of bottom pin cylinder 94 and this actuates the locking mechanism when bottom pin cylinder 94 is turned. Longitudinally extending slots 106 are formed in tubular sleeve portion 73 and they mate with radially extending pins 108 on the outer surface of bottom pin cylinder 94. A plurality of bore holes 110 are also formed in the bottom surface of tubular sleeve portion 73 and it is through these apertures that the bottom pins 100 pass when the combination of the lock assembly is being changed.

The combination of the lock assembly can also be changed by not having to remove the combination top housing and tubular sleeve assembly 24 from padlock assembly 20. In this instance only the bottom pin cylinder 94 is removed and the combination or sequence of the bottom pins 100 is changed and the bottom pin cylinder is then re-inserted back into the combination top housing and tubular sleeve assembly 24.

What is claimed is:

1. A universal lock and key system in which the lock is re-keyable and the key is re-keyable comprising:

a combination top pin housing and tubular sleeve assembly having a top pin housing portion and a tubular sleeve portion and they each have a front end and a rear end;

said top pin housing portion having a longitudinal axis, a top end and a bottom end, a plurality of top pin bore holes are formed in said top pin housing portion and they extend upwardly from its bottom end, said top pin bore holes being aligned with said longitudinal axis, a top pin and spring removably received in most of said bore holes;

means for locking said top pins in said top pin housing portion comprising a longitudinally extending control sheet slot that extends horizontally into said top pin housing from its outer surface to said top pin bore holes and a control sheet that is moveable in and out of said control sheet slot from a position where it engages said top pins to a position where said top pins are completely disengaged;

said tubular sleeve portion being formed on the bottom end of said top pin housing portion and they have aligned longitudinal axes, said bore holes of said top pin housing portion being in communication with the interior of said tubular sleeve portion;

a bottom pin cylinder having a longitudinal axis, a front end, a rear end, a top surface and a bottom surface; a key slot extends longitudinally a predetermined distance into said bottom pin cylinder from its front end, a plurality of longitudinally aligned bottom pin bore holes extend from said top surface into said key slot, a plurality of bottom pins are removably mounted in said bottom pin bore holes; and said bottom pin cylinder being removably mounted in said tubular sleeve portion.

2. A universal lock and key system as recited in claim 1 further comprising gear means for driving said sheet in and out of its top pin engagement position.

3. A universal lock and key system as recited in claim 1 further comprising a control pin in one of the top pin bore holes so that the bottom pin cylinder can be locked in position in the universal lock or be released for removal.

4. A universal lock and key system as recited in claim 1 further comprising means to limit longitudinal insertion of a key in said key slot.

5. A universal lock and key system as recited in claim 1 further comprising means for locking said bottom pin cylinder in said tubular sleeve portion.

6. A universal lock and key system as recited in claim 1 further comprising a shoulder on the rear end of said bottom pin cylinder for actuating means for unlatching a locking mechanism.

7. A universal lock and key system as recited in claim 1 wherein said vertical top pin bore holes extend upwardly to the top end of said top pin housing portion and a removable cover is secured thereto.

8. A universal lock and key system as recited in claim 1 further comprising said tubular sleeve portion having means for removing said bottom pins from said bottom pin cylinder while said bottom pin cylinder remains in said tubular sleeve portion.

9. A universal lock and key system as recited in claim 1 further comprising a key having removable teeth that can be arranged in different sequences to conform to mating bottom pins having different heights.

10. A key comprising:

an elongated shank portion having a front end, a rear end, and a top surface; a tooth slot is formed in said top surface and it extends forwardly from the rear end of said shank portion a predetermined distance, said tooth slot having a left side wall, a right side wall and a bottom wall, a laterally extending groove is formed in at least one of said side walls;

a plurality of key teeth having various predetermined heights, each tooth having a left side wall, a right side wall and a bottom wall, each of said teeth having at least one flange extending laterally from one of its side walls so that said teeth can be slid into the rear of said tooth slot with said flange mating with said laterally extending groove;

a key handle; and means for removably securing said key handle to the rear end of said shank portion.

* * * * *